US010743623B2

(12) United States Patent
Dallavalle

(10) Patent No.: US 10,743,623 B2
(45) Date of Patent: Aug. 18, 2020

(54) BELT BUCKLE AND BELT

(71) Applicant: Tito Dallavalle, North Miami, FL (US)

(72) Inventor: Tito Dallavalle, North Miami, FL (US)

( * ) Notice: Subject to any disclaimer, the term of this patent is extended or adjusted under 35 U.S.C. 154(b) by 5 days.

(21) Appl. No.: 15/933,401

(22) Filed: Mar. 23, 2018

(65) Prior Publication Data

US 2019/0289966 A1 Sep. 26, 2019

(51) Int. Cl.
*A44B 11/00* (2006.01)
*A44B 11/06* (2006.01)

(52) U.S. Cl.
CPC ..... *A44B 11/001* (2013.01); *A44B 11/06* (2013.01)

(58) Field of Classification Search
CPC ..... A44B 11/02; A44B 11/04; A44B 11/06; A44B 11/08; A44B 11/10; A44B 11/12; A44B 11/001
USPC ..... 24/168, 170, 163 R, 163 K
See application file for complete search history.

(56) References Cited

U.S. PATENT DOCUMENTS 2,634,481 A * 4/1953 Katzman ..... A44B 11/001 24/191
4,502,188 A * 3/1985 Kohli ..... A44B 11/001 24/163 K
5,588,186 A * 12/1996 Ko ..... A44B 11/14 24/170
5,615,459 A * 4/1997 Wu ..... A44B 11/14 24/170
6,081,973 A * 7/2000 Liu ..... A44B 11/24 24/170
6,098,252 A * 8/2000 Woerth, Jr. ..... A44B 11/001 24/163 K

* cited by examiner

*Primary Examiner* — William V Gilbert

(57) ABSTRACT

This disclosure relates generally to belt buckles and more particularly to belt buckles that have associated with the face or 'front thereof interchangeable initials, letters or other design. The working mechanics of the buckle is different than any other in the market. The said Buckle has a holding mechanism that won't damage the belt strap because the material that it uses it as explained throughout this patent application. The invention is based to facilitate the user for opening and closing of the belt. Moreover, the said Buckle allows what no any other Buckle allows and is for the strap to pass underneath of the fix portion of the strap, the result is the need not to the strap to be cut to the size of the waist of every individual. I will describe this as unique in today's dress belt market.

1 Claim, 2 Drawing Sheets

BELT BUCKLE AND BELT

BACKGROUND

Field of the Invention

The invention relates to a belt buckle, which comprises an insertion part, having at least on belt opening for guiding a belt and an insertion appendage extending in the direction of insertion with holding catches protruding at both sides in the perpendicular direction, and a receiving part, comprising a basic body with at least one belt opening for guiding a belt and with a latch, extending from an insertion opening beginning at the insertion side of the basic body for inserting the insertion appendage of the insertion part in the direction of insertion and pivotally fastened at the basic body.

This invention relates to belt buckles and more particularly to belt buckles that have associated with the face or front thereof interchangeable initials, letters or other design. The said design or indicia for the current invention is interchangeable with respect to the buckle are in the form of plaques or plates or the like which constitute the entire visible front surface of the buckle proper and the initials or letters are embossed or otherwise formed or placed on the plaques or plates.

Description of the Related Art

A conventional belt buckle uses a structure that fastens the belt at one fixed position at a time, whether it uses a prong to insert into a punch hole or it uses a ratchet piece to hold the belt. So, when a person wears clothes of different materials or outfits of various kinds, or when he sits down, crouches, or takes a different pose, the belt may make him uncomfortable. In the same context, the traditional belt buckles do not allow to adjust the belt fitting easily on click unless been opened and adjusted.

One of the ways to deal with the uncomfortable feeling is to take it easy or entirely ignore it; the other way is to adjust the position the buckle is secured on the belt. The conventional belt seldom uses automatic positioning structure or adjustment through a click; that is, a person must unbuckle the belt many times to adjust the length to fit his waist. If he wants to unfasten or adjust it, he has to leave the table and go to the toilet.

If a prong is not adjusted down to the next punch hole to loosen the belt when required or when the prong is used again and again for the same punch hole the leather, REXINE material (artificial leather leathercloth fabric) or even the clothing texture wears out over time period. The mainly used punch hole as tend to widen up with use over time period.

The traditional buckles also do not provide the provision of changing the brand sign, letters or indicia in them. The traditional buckles or normally on the common wear trouser belts also do not allow the interchangeability of leather or belt material when required or if the material wears out, normally leaving the buckle useless and thrown away with the belt. The invention is based to facilitate the user for opening and closing of the belt, change of the buckle design while retaining the same buckle and safety to the leather or belt material from wear tear caused due to buckling the prong in the punch hole. The previous embodiments in the field did not provide such facilitation and hence the idea has its own novelty.

SUMMARY

The invention is a trouser belt buckle, which has a unique feature for waist adjustment and locking of the belt. The present invention is a metallic buckle which can be attached to any leather, REXINE material belt irrespective of the waist length. The buckle provides a new method of buckling, tying up the belt through an adjustable lever.

The buckle frame has a cover for the belt to penetrate, and the front end of the frame fastens the front end of the belt. The buckle provides the provision of sliding the belt through the buckle from one end and gets locked at the waist as required. While other belts have a prong and punch hole or the traditional buckle system, the current invention allows the buckle to lock the belt at waist line through an adjustable lever through a click.

The invention further allows the user to change the brand, design, indicia, letters or any other sign at the front of the buckle according to the occasion, mood or trouser type. The design can be changed easily through two screws given at the back of the buckle. The change will still not affect the buckle frame as the main frame remains at its place with the new opening mechanism.

While a specific embodiment has been shown and described, many variations are possible. With time, additional features may be employed. Various configuration may be changed to suit the system or equipment with which it is used.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

The prior art for buckle up belts of different material normally require a prong and set of punch holes to hold the belt at different waist lines. Belts are worn normally to hold up the lower garment such as, for example, jeans, shorts, skirts and pants. The belt is inserted through a plurality of belt loops and works by exerting pressure on the waistband of the clothing as it presses against the body to achieve its ability to support the lower garment.

The current invention is a belt buckle made of metal. The working mechanics is based on a lever given at the top side of the belt. The lever is attached to a spring which holds the belt leather strongly. The lever can hold the belt strongly up till 300 pounds of weight without moving the belt leather even an mm. The lever needs to be raised prior to buckling the belt. The lever resets the spring and allows the belt leather to passed and then once the lever is released it holds the belt leather.

Figure 1:
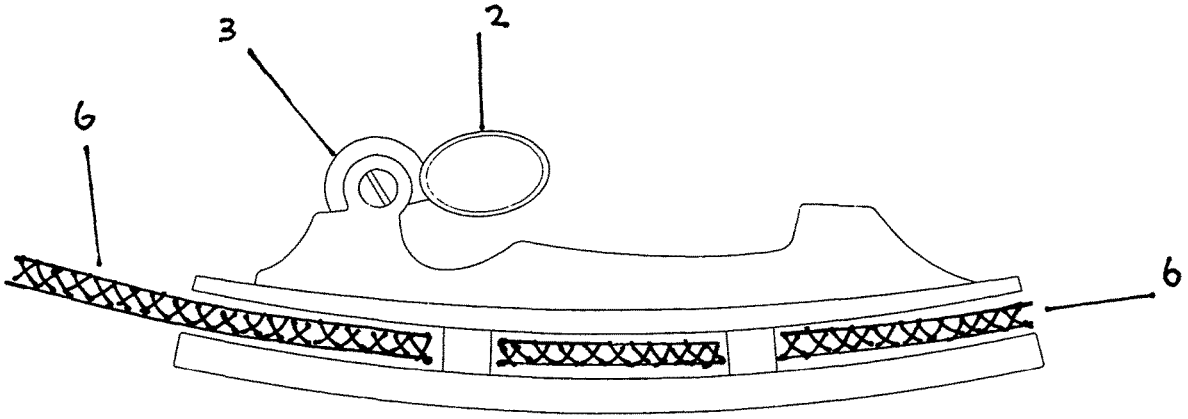
FIG. 1 is a top view of the present invention.

FIG. 1 shows a top view of the buckle. The length of the buckle is 70 mm. The height of the buckle is 41 mm. The buckle is of shape 'H' with a letter T separately attached to it from the back side. The letter T is detachable with the help of screws at the back side. The legs for the shape T & H are 15 mm each and the center strip of letter 'H' is of 10.5 mm. The belt strap 6 passes between a main plate 3, as disclosed, and a second member. Fastening member 2 is pivotally secured to the main plate.

Figure 2:
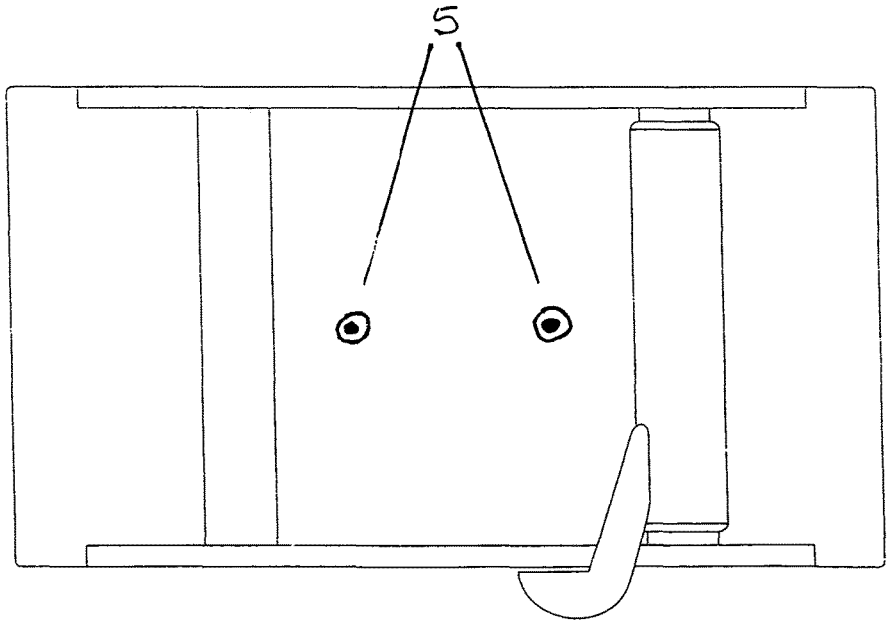
FIG. 2 is a back view of the present invention.

FIG. 2 shows the back side of the buckle. The diagram shows two screws 5 at the back of the buckle. The screws can be opened to remove the front logo (see 4 of FIG. 4) of leather of the belt if permanently attached. The width is same as 41 mm. At the back side the buckle has two metallic strips one of 7 mm and the other of 8.5 mm. The lever to hold and release the belt is attached to the metallic strip 8.5 mm. The buckle is supported through thick metallic strips.

Figure 3:
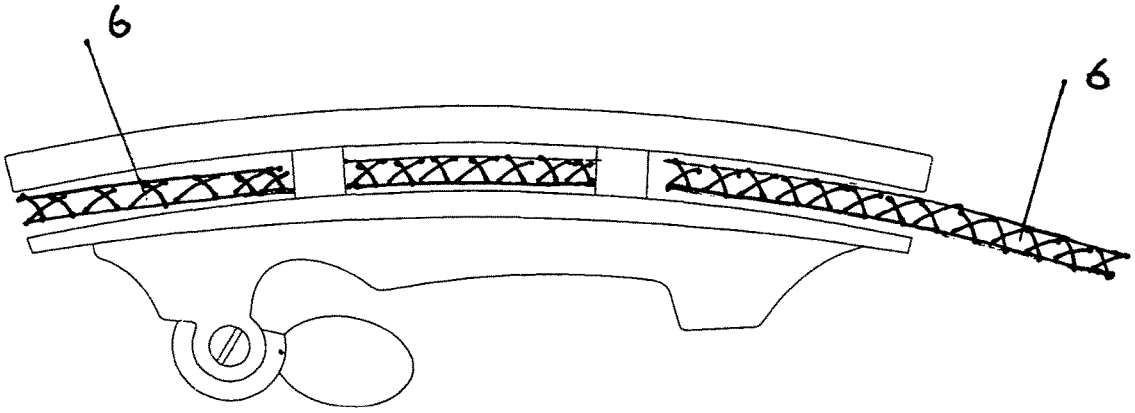
FIG. 3 is a lower view of the present invention.

FIG. 3 shows a bottom view of the buckle It clearly shows the lever (2 as labeled in FIG. 1) attached to the buckle. The buckle lever is attached to a spring; the lever triggers the spring attached to the rubber module. The spring then further holds the leather of the belt and does not allow it to move, hence giving a firm grip. The diagram also show the place from where the belt 6 will pass before getting buckled in.

Figure 4:
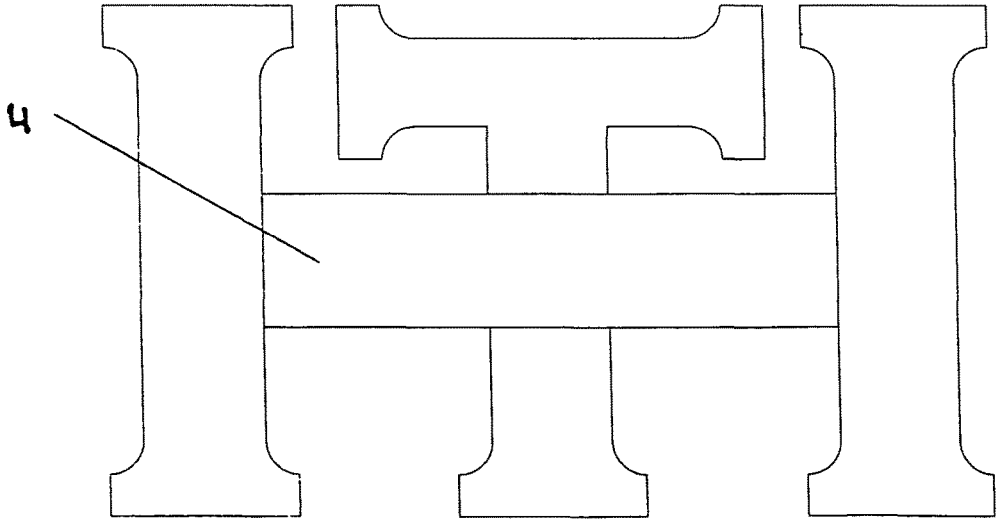
FIG. 4 is a front view of the present invention.

FIG. 4 shows a front view of the buckle with a logo 4 attached. As previously described, screws 5 attach the logo to the main plate 3. The total width of the buckle is 23.5 mm. The slot for slid ng of the belt is 4 mm and the front metal is of 3 mm.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The invention claimed is:

1. A belt buckle and a belt consisting of:

said belt being consisting of leather;

said buckle consisting of a first plate and a second member, wherein said first plate and said second member define a space therebetween, said first plate having a first side and a second side opposite said first side, said first plate having a first flange at said first side and a second flange at said second side, said flanges extending away from said second member, and a first member extending from said first flange to said second flange;

said belt having a first end portion received in said space;

a first screw and a second screw connecting said first plate to said second member, said first screw and said second screw extending through said belt;

a lever attached to said first flange at a distal portion of said first flange with respect to said second member, said lever tapering in a direction from said first flange to said second flange and terminating between said first flange and said second flange, said lever having a spring connected to a rubber module that extends from said first flange to said second flange, said rubber module spaced from said first member;

said belt having a second end portion opposite said first end portion, said second end portion configured to fit between said first flange and said second flange, said second end portion configured to fit between said first plate and said rubber module is configured to retain said second end portion in a fixed position.

* * * * *